US006543517B2

(12) United States Patent
Welfonder

(10) Patent No.: US 6,543,517 B2
(45) Date of Patent: Apr. 8, 2003

(54) CARRIER AND SPACER ASSEMBLY

(75) Inventor: Konrad Welfonder, Bremerhaven (DE)

(73) Assignee: Hunter Douglas Industries B.V., El Rotterdam (NL)

( * ) Notice: Subject to any disclaimer, the term of this patent is extended or adjusted under 35 U.S.C. 154(b) by 0 days.

(21) Appl. No.: 10/085,534

(22) Filed: Feb. 26, 2002

(65) Prior Publication Data

US 2002/0084043 A1 Jul. 4, 2002

Related U.S. Application Data

(63) Continuation of application No. 09/580,815, filed on May 26, 2000.

(30) Foreign Application Priority Data

May 31, 1999 (EP) ..... 99201729

(51) Int. Cl.[7] ..... E06B 9/30

(52) U.S. Cl. ..... 160/168.1; 160/168.1; 160/173 V; 160/167.4 V; 160/178.1 V; 160/177.1 V; 160/900; 24/16 PB

(58) Field of Search ..... 160/168.1 V, 173 V, 160/167.1 V, 178.1 V, 177 V, 900; 24/16 PB

(56) References Cited

U.S. PATENT DOCUMENTS

| | | | | | |
|---|---|---|---|---|---|
| 2,785,743 | A | * | 3/1957 | Kiefer | 160/173 V |
| 2,869,636 | A | | 1/1959 | Klenz | |
| 3,883,950 | A | * | 5/1975 | Kurtz | 30/106 |
| 4,140,169 | A | | 2/1979 | Arena | 160/178.1 V |
| 4,214,622 | A | | 7/1980 | Debs | 160/168.1 V |
| 4,335,775 | A | | 6/1982 | Frentzel et al. | |
| 4,489,730 | A | * | 12/1984 | Jingu | 128/660 |
| 4,559,670 | A | | 12/1985 | Wyatt | |
| 4,662,422 | A | | 5/1987 | Anderson | |
| 4,732,202 | A | | 3/1988 | Anderson | |
| 4,733,435 | A | * | 3/1988 | Darner | 16/87.4 |
| 4,791,703 | A | | 12/1988 | Chang | 160/168.1 V |
| 4,872,499 | A | * | 10/1989 | Anderson | 160/168.1 |
| 4,887,657 | A | | 12/1989 | Spohr | |
| 4,928,744 | A | | 5/1990 | Oskam | |
| 4,958,672 | A | | 9/1990 | Meyer | 160/168.1 V |
| 5,092,386 | A | | 3/1992 | Spohr et al. | |
| 5,289,863 | A | | 3/1994 | Schon | 160/168.1 V |
| 5,611,385 | A | | 3/1997 | Hsu | 160/173 |
| 5,626,177 | A | | 5/1997 | Colson et al. | 160/168.1 V |
| 5,927,367 | A | * | 7/1999 | Toti | 160/173 V |
| 6,073,672 | A | | 6/2000 | John | 160/168.1 V |
| 6,164,762 | A | * | 12/2000 | Sullivan et al. | 347/56 |

* cited by examiner

*Primary Examiner*—Bruce A. Lev
(74) *Attorney, Agent, or Firm*—Dorsey & Whitney LLP

(57) ABSTRACT

A carrier and spacer assembly for an architectural covering, such as a vertical Venetian blind, comprising a longitudinally-arrayed plurality of carriers that are slidably arranged for longitudinal movement along a longitudinally-extending tilt rod between open and closed positions. In the open position, the carriers are spaced apart along the tilt rod, and in the closed position, the carriers are adjacent to one another at a one end of the tilt rod. A mechanism is provided for pulling a first carrier along the tilt rod between the open and closed positions. A plurality of elongated spacers are disposed between the adjacent carriers, connecting them together along the tilt rod. Each spacer includes a leading end portion which extends towards the open position and engages a carrier and a trailing end portion which extends towards the closed position and engages an adjacent carrier. The trailing end portion of each spacer is longitudinally overlapped by the leading end portion of the adjacent spacer, wherein the leading end portion of each spacer contacts a carrier laterally farther from the tilt rod than its trailing end portion contacts an adjacent carrier when the carriers and spacers are moved longitudinally towards the open position.

18 Claims, 3 Drawing Sheets

CARRIER AND SPACER ASSEMBLY

CROSS-REFERENCE TO RELATED APPLICATION

This application is a continuation of U.S. Ser. No. 09/580,815 filed May 26, 2000, allowed, which corresponds to and claims priority to European Serial No. 99201729.3, filed May 31, 1999. The U.S. application Ser. No. '815 and the European application Serial No. 99201729.3 are hereby incorporated by reference as though fully set forth herein.

BACKGROUND OF THE INVENTION a. Field of the Invention

This invention relates to a carrier and spacer assembly for a head rail of an architectural covering, such as a covering for an architectural opening, like a window or door. This invention particularly relates to carriers and spacers for holding, moving and tilting vertically arranged louvers of a louvered venetian blind.

b. Backgound Art

Vertical venetian blinds have generally been provided with horizontally-extending head rails, holding a plurality of carriers or travellers that can be moved in spaced apart relationship along the longitudinal length of each head rail. Each carrier has typically supported a vertically-extending louver or slat in such a manner that the consumer of the venetian blind could move the louver along the length of the head rail (e.g., by pulling on a first operating cord or pull cord) and also could rotate or tilt the louver about its vertical axis (e.g., by pulling on a second operating cord or tilt cord). For this purpose, each carrier has typically included a vertically oriented, drive hub or worm wheel, provided on top with a worm gear or the like. The bottom of each drive hub has supported a depending louver holder, adapted to hold securely the top of a louver while its carrier has been moved longitudinally and while the drive hub has been rotated so as to move the louver holder and the louver and tilt them about their common vertical axis. In this regard, a longitudinally-extending tilt rod or drive shaft has been provided in the head rail, extending through the carriers and engaging their worm gears, whereby rotation of the tilt rod about its longitudinal axis has caused the drive hubs of the carriers to rotate about their vertical axes so as to make the louver holders and the attached louvers tilt together.

The carriers in the head rails of vertical venetian blinds have also generally been provided with a plurality of longitudinally-extending spacers which keep the carriers and the louvers, supported by the carriers, in spaced-apart relationship when the carriers and louvers are moved longitudinally along the head rail, apart from each other, to close the blinds and cover their windows. The spacers have generally been longitudinally-elongated thin pieces of stainless steel or the like. Typically, the rear or closed end of each spacer has been fixed on a carrier and the front or open end has been slidably positioned on a smooth horizontal surface within a longitudinally-extending channel or groove of an adjacent carrier. When a blind has been closed, the front or lead carrier of the blind has been pulled frontally, away from its (rearwardly) adjacent carrier and has slid along the spacer that is slidably positioned within its channel and fixed to the adjacent carrier; when the lead carrier has reached the open end of the spacer of the adjacent carrier, the lead carrier has then started to pull the adjacent carrier frontally, and the adjacent carrier has slid along the spacer that is slidably positioned within its channel and fixed to the next (rearwardly) adjacent carrier. This has continued until all the carriers are spaced apart by the spacers between them. When the blind has been closed, the lead carrier of the blind has been pulled rearwardly, towards its adjacent carrier and has slid along the spacer that is slidably positioned within its channel and fixed to the adjacent carrier; when the lead carrier has reached the adjacent carrier, the lead carrier has then started to push the adjacent carrier rearwardly, and the adjacent carrier has slid along the spacer that is slidably positioned within its channel and fixed to the next adjacent carrier. This has continued until all the carriers have been pushed together. See, for example, the carriers and their spacers in U.S. Pat. Nos. 5,092,386, 4,887,657, 4,732,202, 4,559,670 and 4,335,775.

However, vertical venetian blinds have generally not been as easy for consumers to open and close as blind manufacturers would wish. This has been due to friction between the moving parts of the head rails of such blinds. Friction in the head rails has required consumers to expend significant amounts of energy when using the pull cords of the blinds or required relatively heavy motors for motor-operated blinds.

BRIEF SUMMARY OF THE INVENTION

It is an object of the invention to overcome or at least reduce the above problems.

In accordance with a first aspect of this invention, a carrier and spacer assembly is provided for an architectural covering, such as a vertical venetian blind, that comprises:

a plurality of elongate, vertically-extending, covering portions which can be moved longitudinally between first and second positions;

a longitudinally-arrayed plurality of carriers, each of which is connected to an upper end portion of one of the covering portions; the plurality of carriers including a lead first carrier and a second carrier, adapted to be moved longitudinally by longitudinal movement of the first carrier, and a third carrier, adapted to be moved longitudinally by longitudinal movement of the second carrier;

a longitudinally-extending tilt rod, along which the carriers, are slidably arranged and can be moved longitudinally, with the covering portions, between the first and second positions; in one of the positions, the covering portions being spaced apart along the tilt rod, and in the other position, the covering portions being adjacent to one another at a longitudinal end of the tilt rod;

means for pulling the first carrier along the tilt rod between the first and second positions; and means for moving the other carriers, with the first carrier, along the tilt rod between the first and second positions; the moving means including a longitudinally-arrayed plurality of longitudinally-extending spacers, each of which is provided between a pair of adjacent carriers; each spacer having a leading end portion which extends towards the first position and engages a carrier, and a trailing end portion which extends towards the second position and engages an adjacent carrier; the trailing end portion of each spacer and the leading end portion of the adjacent spacer being longitudinally overlapped;

wherein the leading end portion of each spacer contacts a carrier farther from the tilt rod than its trailing end portion contacts an adjacent carrier when the carriers and spacers are moved longitudinally towards the first position, whereby the carriers are easier to move longitudinally towards the first position, particularly where the first position is the closed position of the architectural covering and the second position is the open position of the architectural covering.

Advantageously, the tilt rod and the spacers are on laterally opposite sides of the carriers and the leading end portion of each spacer contacts a carrier laterally farther from the tilt rod than its trailing end portion contacts an adjacent carrier when the carriers and spacers are moved longitudinally toward the first position. It is especially advantageous that the spacers are horizontally aligned and the trailing end portion of each spacer underlies the leading end portion of an adjacent spacer. It is particularly advantageous that: the spacers are elongate strips and each carrier includes a channel, within which a spacer can move longitudinally along a horizontal bottom surface of the channel; and the trailing end portion of a spacer and the overlying leading end portion of an adjacent spacer are positioned in the channel with sufficient lateral play to allow relative angular sliding movement of the end portions of the spacers and of the channel of the carrier when the spacers and the carrier are moved longitudinally. It is quite particularly advantageous that only a lateral side portion of the trailing end portion of each spacer engages a carrier; and the lateral side portion is closer to the tilt rod than is a longitudinal center of the spacer. In this regard, it is especially advantageous that the leading end portion of each spacer includes an upwardly extending hook which can contact a lateral surface portion of a bridge overlying a horizontally-extending channel of a carrier, within which channel the spacers can move longitudinally; and the trailing end portion of the spacer includes a downwardly-extending hook adapted to contact only a lateral surface portion of an adjacent carrier that is laterally closer to the tilt rod than is the lateral surface portion of the bridge. Advantageously, the lateral surface portion of the adjacent carrier is outwardly adjacent to the channel and forms a part of a bottom edge of the channel, which bottom edge is tapered, laterally away from the tilt rod, in the first direction, particularly where the bottom edge is tapered at an angle of less than about 10°, quite particularly at an angle of about 0.5–5°.

In accordance with a second aspect of this invention, a carrier is provided for a head rail of an architectural covering, that is easier to move along a longitudinally-extending spacer in the head rail and that comprises: a longitudinally-extending channel, in which the spacer can be slidably positioned; opposite longitudinally-extending sides of the channel being tapered laterally outwardly of the channel from the center of each lateral side to its laterally-extending sides. Advantageously, each longitudinally-extending side of the channel is tapered laterally outwardly of the channel from the center of each longitudinally-extending side to its laterally-extending side at an angle of less than about 10°, preferably at an angle of about 0.5–5°. It is particularly advantageous that the channel comprise a longitudinally-extending horizontal surface and upstanding, opposite longitudinally-extending sides; a trailing end position of one of a longitudinally-arrayed plurality of spacers underlying the leading end portion of an adjacent one of the spacers on the horizontal surface.

In accordance with a third aspect of this invention, a head rail is provided for an architectural covering, including the carrier and spacer assembly of the invention.

In accordance with a fourth aspect of this invention, an architectural covering, particularly a vertical venetian blind, is provided, comprising the head rail of the invention.

DESCRIPTION OF THE PREFERRED EMBODIMENTS

Further aspects of the invention will be apparent from the detailed description below of a particular embodiment and the drawings thereof.

Figure 1:
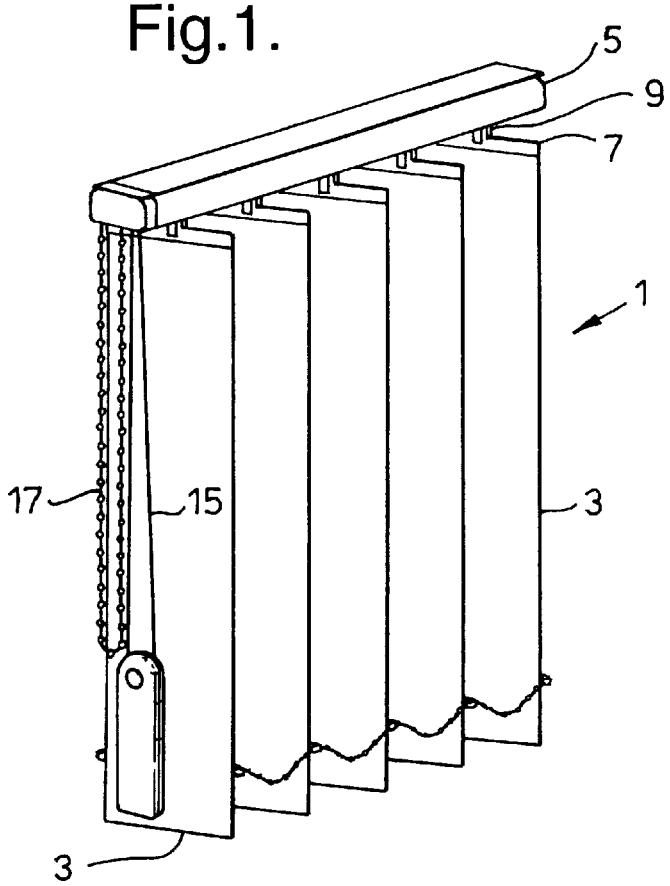
FIG. 1 is a perspective side view of a vertical venetian blind with a head rail that supports a plurality of vertical louvers by means of a carrier and spacer assembly of this invention.

FIG. 1 shows a vertical blind 1 having a plurality of vertical louvers 3 suspended from its horizontally- and longitudinally-extending head rail 5. The louvers 3, shown in FIG. 1, are conventional metal, plastic or fabric slats, each having an upper marginal portion 7 securely suspended vertically from a holder 9, supported by the carriers (not shown) in the head rail 5.

Figure 2:
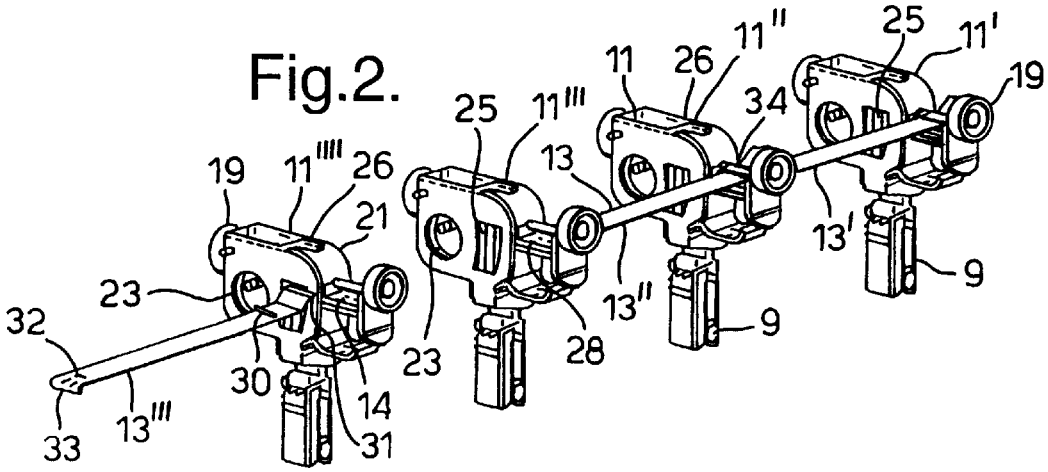
FIG. 2 is a perspective side view of four of the carriers and spacers within the head rail of FIG. 1, with one carrier and one spacer detached from the others.

FIG. 2 shows a longitudinally-arrayed plurality of the carriers, generally 11, within the head rail 5 shown in FIG. 1. (For clarity, the head rail 5 is not shown in FIGS. 2–4). The bottom of each carrier 11 has one of the holders 9 extending downwardly from about its lateral and longitudinal center. The carriers 11 and holders 9 are preferably made of plastic.

A longitudinally-arrayed plurality of longitudinally-extending elongate spacers generally 13, are also provided in the head rail 5. The spacers 13 are on one longitudinally-extending side of the carriers 11 and are preferably made of thin stainless steel or plastic. The spacers 13 keep the carriers 11 in longitudinally spaced-apart relationship when the carriers are moved to the right along the head rail 5—from a position, in which they are stacked at the left end of the head rail when the blind 1 is open to another position in which they are spread apart along the length of the head rail when the blind 1 is closed. In this regard, each carrier 11 preferably has a longitudinally-extending channel 14, in which a spacer 13, attached to an adjacent carrier, can slide longitudinally as described below.

As shown in FIG. 1, the left side of the head rail 5 is provided with a conventional pull cord 15 connected to a conventional lead carrier 11'. As seen from FIGS. 2 and 3, the lead carrier 11, is adapted: i) to be moved by the pull cord 15 to the right along the head rail Sand then to pull the other carriers 11", 11'", 11'", etc.—by means of the spacers 13—to the right along the head rail to close the blind 1; and ii) to be moved by the pull cord 15 to the left along the head rail 5 and then to push the other carriers 11", 11'", 11'", etc. to the left along the head rail 5 to open the blind 1.

As also shown in FIG. 1, the left side of the head rail 5 is also provided with a conventional bead chain 17. The bead chain 17 serves as a tilt cord for rotating a conventional longitudinally-extending grooved tilt rod 18 (shown in FIG. 3) of the head rail 5, so as to tilt the holders 9 and thereby tilt their louvers 3.

Except as described below with reference to FIGS. 3–6, the head rail 5 and its components, as shown in FIGS. 1 and 2, are conventional. In this regard, the structure of the carriers 11, holders 9, spacers 13 and louvers 3 and their controlled longitudinal movement along the length of the head rail 5 and the controlled tilt of the carriers 11 and louvers 3 are generally known (e.g., from U.S. Pat. Nos. 4,732,202 and 4,335,775).

In particular, each carrier 11, as shown in FIG. 2, has a pair of conventional rollers or wheels 19 on opposite longitudinally-extending sides of its housing 21. The carrier moves on the rollers 19 along longitudinally-extending tracks (not shown) on laterally opposite sides of the interior of the head rail 5, along its length, in response to movement of the pull cord 15.

The housing 21 of each carrier 11 also has a pair of conventional, longitudinally-aligned circular openings 23. The openings 23 are located on longitudinally opposite sides of the carrier and on the lateral side of the carrier opposite the spacers. The tilt rod 18 of the head rail 5 can pass through the openings 23 to engage a worm gear (shown schematically in FIG. 3), driving a conventional drive hub 25 within the carrier housing 21, so that rotation of the tilt rod, in response to movement of the bead chain 17, causes rotation of the drive hub 25 within the carrier. In this regard, the openings 23 are preferably located rearwardly of the drive hub 25 which is located rearwardly of the spacers 13, whereby the tilt rod 18 is located at the rear of the head rail and rearwardly of the spacers 13.

A lower portion of each drive hub 25 holds a vertically-extending upper part of one of the holders 9 which support the louvers 3. In this regard, a pair of conventional vertically-aligned circular openings 26 are also provided on the top and bottom of the housing 21 of each carrier, near its lateral and longitudinal center, to accommodate its hub 25 and holder 9.

Figure 3:
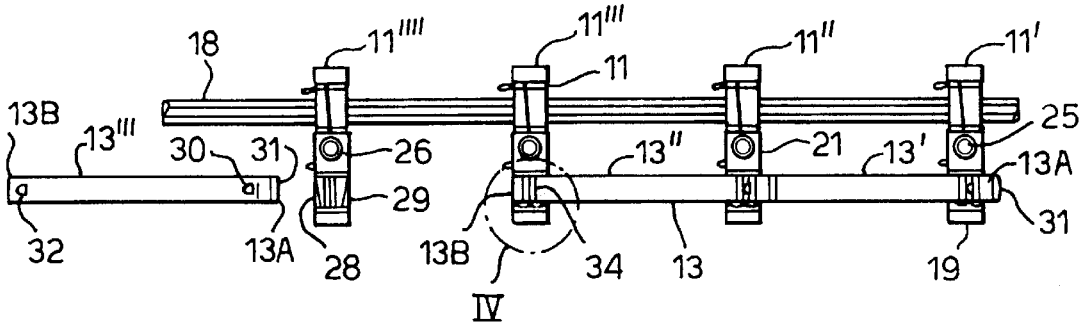
FIG. 3 is a top view of the four carriers and spacers of FIG. 2.

FIGS. 2 and 3 show the longitudinally-arrayed plurality of the carriers 11 and their channels 14, in which are the longitudinally-arrayed plurality of spacers 13. In a conventional manner, the right or leading end 13A of each spacer (e.g., 13") overlaps longitudinally the left or trailing end 13B of an adjacent spacer (e.g., 13'), to the right. Also in a conventional manner, the trailing end 13B of each spacer (e.g., 13") is fixed to an innermost surface 27 of the channel 14 of a carrier (e.g., 11'"), adjacent the left or trailing end 28 of the innermost surface 27 of the channel 14. Further in a conventional manner, each spacer (e.g., 13") is adapted to slide smoothly in a longitudinal direction, within the channel 14 of an adjacent carrier (e.g., 11"), to the right, and past the trailing end 13B of an adjacent spacer (e.g., 13'), to the right, that is fixed to the trailing end 28 of the innermost surface 27 of the channel 14 of the adjacent carrier, and past the right or leading end 29 of the innermost surface 27 of the channel of the adjacent carrier when the carriers 11 and the louvers 3 thereon are moved to the right to close the blind 1 or moved to the left to open it. As shown in FIGS. 2–3, it is preferred that the spacers 13 are horizontally aligned, and accordingly, the leading end 13A of each spacer (e.g., 13") overlies the trailing end 13B of an adjacent spacer (e.g., 13'), to the right, and the innermost surface 27 of the channel 14 of each carrier 11, to which the trailing end 13B of one of the spacers (e.g., 13") is fixed, is the channel's bottom surface 27 which is also preferably aligned horizontally.

As seen from FIGS. 2–6, there is preferably a first hook 30, near the leading end 13A of each spacer 13, that extends upwardly and to the left and a second hook 31, at the leading end 13A of each spacer 13, that extends upwardly and to the left. There is preferably also a third hook 32 that is near the trailing end 13B of each spacer 13, that extends downwardly and to the left into a hole 32A (shown in FIG. 5) in the bottom surface 27 of the channel 14, adjacent its trailing end 28, that can pivot laterally within the hole 32A and that can engage a confronting laterally-extending trailing edge of the hole 32A when moved to the left, relative to the hole. In addition, a fourth hook 33, at the trailing end 13B of each spacer 13, preferably extends downwardly and to the left and is located to the left of, and in contact with, the trailing end 28 of the bottom surface 27 of the channel 14. The hooks 30–34 are preferably symmetrical about the longitudinally-extending center axis of each spacer 13.

In a conventional manner: the first hook 30 of each spacer (e.g., 13"), fixed to a carrier (e.g., 11'"), engages a laterally-extending bridge member 34 overlying the channel 14 of the adjacent carrier (e.g., 11"), to the right, so that the spacer (e.g., 13") and its carrier (e.g., 11'") are pulled to the right when the adjacent carrier (e.g., 11") is moved to the right to close the blind 1; and the second hook 31 of the spacer (e.g., 13") keeps its leading end 13A from moving beneath the bridge member 34 of the channel 14 of the next adjacent carrier (e.g., 11') when the next adjacent carrier is moved to the left towards the adjacent carrier (e.g., 11") to open the blind 1. The third and fourth hooks 32, 33 of each spacer (e.g., 13") hold, between them, the trailing edge of the hole 32A in the bottom surface 27 of the channel 14 of the carrier (e.g., 11'"), to which the spacer is fixed, and the trailing end 28 of the bottom surface 27 of the channel of the carrier in a generally conventional manner, except as described below. Thereby, the third and fourth hooks 32, 33 hold the trailing end 13B of the spacer (e.g., 13") adjacent the trailing end 28 of the bottom surface 27 of the channel 14 of the carrier (e.g., 11'"). In this regard, the fourth hook 33 of the spacer (e.g., 13") engages the trailing end 28 of the bottom surface 27 of the channel 14 of the carrier (e.g., 11'") and urges the carrier to the right when the spacer is pulled to the right with the adjacent carrier (e.g., 11"), to the right, to close the blind 1.

Figure 4:
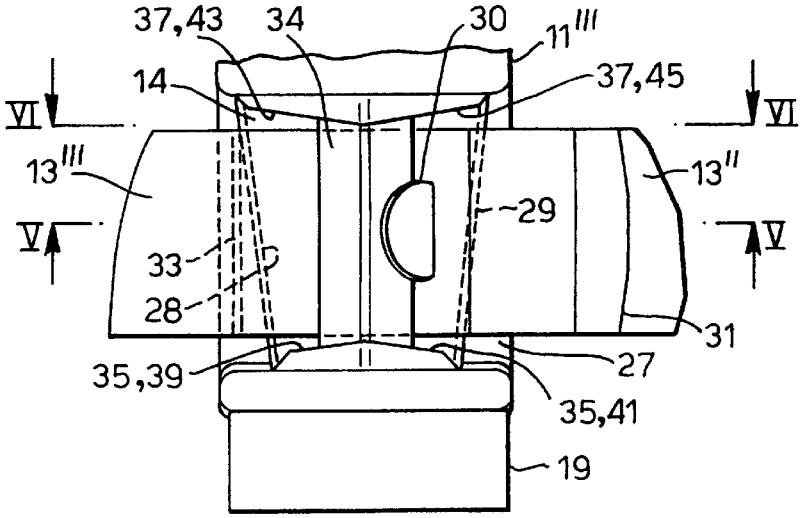
FIG. 4 is an enlarged detail top view of the circled area IV in FIG. 3, showing the attachment of two spacers to one of the carriers.
Figure 5:
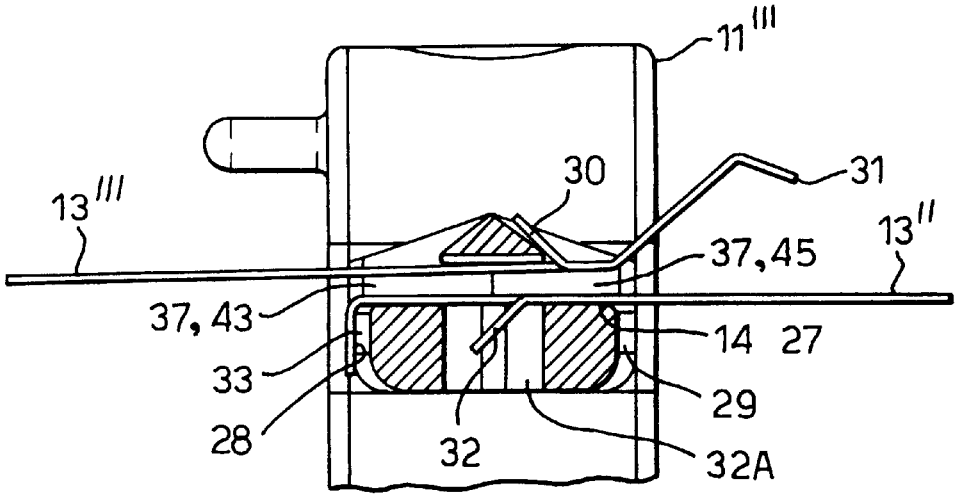
FIG. 5 is a sectional view, taken along line V—V in FIG. 4.
Figure 6:
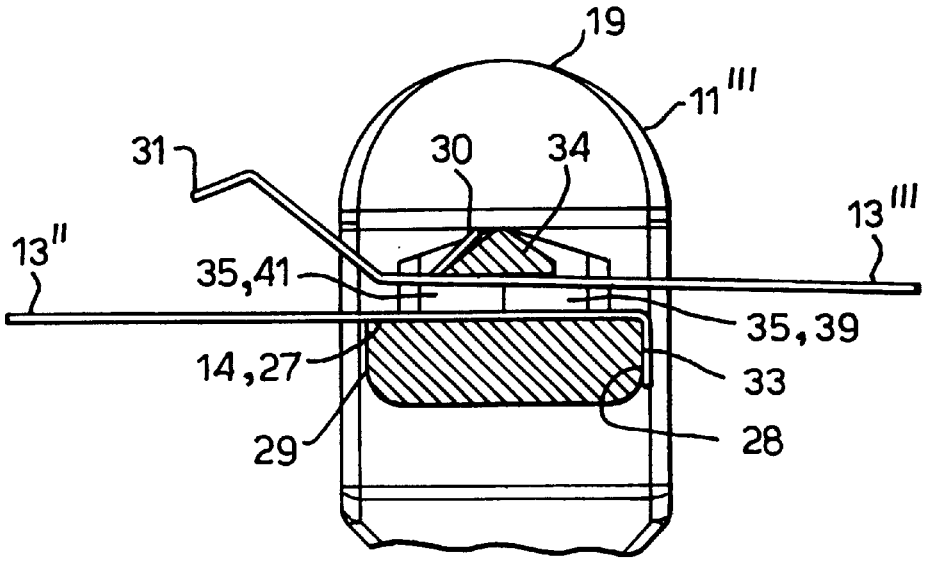
FIG. 6 is a sectional view, taken along line VI—VI in FIG. 4.

In accordance with one aspect of this invention, the upstanding longitudinally-extending sides 35 and 37 of the channel 14 of each carrier 11 are tapered laterally outwardly of the channel 14 from the longitudinal center of each longitudinally-extending side to its laterally-extending sides as best shown in FIGS. 4–6. In this regard, the left and right parts, 39 and 41 respectively, of the front side 35 of the channel 14, shown in FIGS. 4 and 6, are tapered frontally from the longitudinal center of the front side 35 to its left and right sides. Likewise, the left and right parts, 43 and 45 respectively, of the rear side 37 of the channel 14, shown in FIGS. 4 and 5, are tapered rearwardly from the longitudinal center of the rear side 37 to its left and right sides. The dimensions of the taper of the front and rear parts of the longitudinally-extending sides 35, 37 are not considered critical, but a taper for each part of an angle of less than about 10° is generally preferred, particularly an angle of about 0.5–5° (i.e., about 0.005–0.1 mm).

The taper of the left parts 39, 43 and right parts 41, 43 of the front and rear sides 35, 37 of the channel 14 of each carrier 11, in accordance with this invention, allows each carrier 11 to yaw (i.e., pivot laterally) somewhat, relative to the spacer 13 within the channel 14, when the carrier is moved longitudinally to open and close the blind 1—without the longitudinally-extending sides of the spacer 13 rubbing excessively against the longitudinally-extending sides 35, 37 of the channel.

For example, when the pull cord 15 is moved so as to close the blind 1, the lead carrier 11' moves to the right along the head rail 5 and along a first spacer (e.g., 13'), slidably positioned within the lead carrier's channel 14, until the lead carrier reaches the right side of the first spacer 13'. Then as the lead carrier 11' continues to move to the right, the bridge member 34 of the channel 14 of the lead carrier 11' pulls the first hook 30 of the first spacer 13' to the right, and the third and fourth hooks 32, 33 of the first spacer 13' pull the adjacent second carrier 11" to the right, whereby the second carrier moves along the second spacer 13", slidably positioned within the second carrier's channel 14, until the second carrier 11" reaches the right side of the second spacer 13". As the lead carrier 11" continues to move to the right, this process continues until all the carriers 11 have been moved apart to the right to close the blind 1.

During this process of closing the blind 1, the carriers 11 will tend to yaw because the third and fourth hooks 32, 33 of the spacers 13 do not pull the carriers from their lateral centers (or longitudinally-extending axis). Rather, the spacers 13 pull on only one side of the lateral centers (i.e., the front) of the carriers 11. Such inevitable yaw can cause friction between the moving spacers 13 and carriers 11. In this regard, yaw can cause the longitudinally-extending sides of a carrier's channel 14 to rub against the longitudinally-extending sides of the spacer within the channel. However, tapering the left and right parts 39, 41, 43, 45 of the longitudinally-extending sides 35, 37 of the channel 14 allows each carrier 11 to slide more freely and with less friction past the spacer 13 within its channel when the carrier yaws. This is because the longitudinally-extending sides of the spacer are less likely to rub against either longitudinally-extending side 35, 37 of the channel 14 and are much less likely to rub simultaneously against both longitudinally-extending sides of the channel when the carrier yaws.

In accordance with another aspect of this invention, the trailing end 28 of the bottom surface 27 of the channel 14 of each carrier 11 is tapered inwardly (to the right) of the channel, from the rear end of the trailing end 28 to its front end as shown in FIGS. 3–6. Preferably, the leading end 29 of the bottom surface 27 of the channel 29 of each carrier 11 is also tapered longitudinally inwardly (to the left) of the channel from the rear end of the leading end 29 to its front end as shown in FIGS. 3 and 4, so that the carrier 11 can be used to open and close the blind in either longitudinal direction. As a result of the trailing end 28 of the bottom surface 27 of the channel 14 of each carrier 11 being tapered longitudinally inwardly of the channel, the fourth hook 33 is adjacent to the trailing end 28 only adjacent the left part 43 of the rear side 37 of the channel 14. The dimensions of the taper of the trailing and leading ends 28, 29 of the channel 14 of each carrier are not considered critical, but a taper for each edge of an angle of less than about 10° is generally preferred, particularly an angle of about 0.5–5° (i.e., about 0.005–0.1 mm).

The taper of the trailing end 28 of the bottom surface 27 of the channel 14 of each carrier 11, in accordance with this invention, tends to reduce substantially friction between the carrier 11 and the tilt rod 18 (as shown in FIG. 3) when the carrier is pulled to the right (as shown in FIGS. 2–3) along the tilt rod by the fourth hook 33 of the spacer 13, fixed to its trailing end 28, to close the blind 1. Significant friction results from the fact that all the carriers 11, pulled to the right by the lead carrier 11', tend inevitably to yaw counter-clockwise when viewed from the top (as in FIGS. 3 and 4), because the fourth hooks 33 of the spacers 13 pull the carriers to the right on only one side of the lateral centers (i.e., the front) of the carriers. Such yaw causes the edges of the right openings 23 of the carrier housings 21, as well as the worm gears within the carrier housings, to be urged rearwardly against the tilt rod 18, thereby increasing the friction between them as the carriers are pulled to the right along the tilt rod.

However, such counter-clockwise yaw is substantially reduced with each of the carriers (e.g., 11") of this invention because the fourth hook 33 of the spacer (e.g., 13'), fixed to the trailing end 28 of the bottom surface 27 of the channel 14 of the carrier, pulls the trailing end 28 of the carrier only adjacent the rear side 37 of its channel 14—which is laterally closer to the tilt rod 18. As a result, the counter-clockwise yaw of the carrier (e.g., 11") is reduced. In addition, the first hook 30 of the spacer (e.g., 13"), attached to the bridge 34 of the carrier (e.g., 11"), pulls the bridge to the left (as shown in FIGS. 2–3) as a result of the inertia of the remaining stack of spacers (not shown), to be pulled to the right to close the blind 1. As a result, the carrier (e.g., 11") pivots clockwise somewhat, so that its counter-clockwise yaw is substantially reduced. Thereby, the edges of the right opening 23 of the carrier housing 21, as well as the worm gear within the carrier housing, are less forcefully urged rearwardly against the tilt rod 18 and the friction is substantially reduced between them as the carrier (e.g., 11") is pulled to the right along the tilt rod to close the blind.

This invention is, of course, not limited to the above-described embodiment which can be modified without departing from the scope of the invention or sacrificing all of its advantages. In this regard, the terms in the foregoing description and the following claims, such as "longitudinal", "lateral", "above", "below", "top", "bottom", "vertical", "horizontal", "right", "left", "front", "rear", "frontally" and "rearwardly", have been used only as relative terms to describe the relationships of the various elements of the carrier and spacer assembly of the invention for a head rail of an architectural covering. In this regard, the vertical louvers 3 of the vertical blinds 1 could be replaced by other vertical sections of an architectural covering, for example by: i) vertical sections of a conventional drapery fabric or a vaned fabric as described in PCT publication WO 96/35854 or ii) vertical vanes as described in PCT publication WO 96/35881.

Furthermore, the reduction in friction between the carriers 11 and the tilt rod 18, when closing the blind 1, could also be achieved by tapering longitudinally outwardly the fourth hook 33 of each 13, rather than tapering longitudinally inwardly the adjacent trailing edge 28 of the innermost surface 27 of the longitudinally-extending channel 14 of each carrier 11, 50 that the fourth hook 33 would only contact the rear portion of the trailing edge 28 of the carrier s channel when pulling the trailing edge 28 to close the blind 1. Moreover, such reduction in friction could be further reduced by having the first hook 30 of each spacer located frontally of its longitudinally-extending center axis, so that the first hook 30 contacts the bridge 34 of the carrier 11, to which it is attached, frontally of the longitudinally-extending center axis of the carrier's channel 14, in order that the carrier pivots clockwise (as viewed in FIGS. 3 and 4) somewhat more under the effects of the pull to the left of the first hook when closing the blind 1.

Moreover, the spacers 13 could also be aligned generally vertically, instead of horizontally, and could be on the same, instead of the opposite, longitudinally-extending side of the carriers 11 as the openings 23 in their housings 21 and the tilt rod 18, passing through the openings. Accordingly, the innermost surface 27 of the channel 14 of each carrier 11 could be an upstanding, vertically-aligned surface, instead of a horizontally-aligned bottom surface as shown in FIGS. 1–6.

Alternatively, the spacers 13 could be replaced by flexible chains or ropes that are fixed to adjacent carriers 11 as described, for example, in U.S. Pat. No. 2,869,636. In this regard, the leading end portion of each flexible chain or rope could be suitably attached to a carrier (e.g., 11") farther from a tilt rod (18) than its trailing end portion is attached to an adjacent carrier (e.g., 11").

I claim:

1. A carrier and spacer assembly for a head rail of an architectural covering the architectural covering including a plurality of covering elements, said carrier and spacer assembly comprising: (i) at least one longitudinally-extending spacer, (ii) a longitudinally-extending channel in which the at least one longitudinally-extending spacer is slidably positioned, said channel having opposite generally longitudinally-extending sides, each side having a center with left and right portions on either side of the center that terminate at opposite laterally-extending sides of the channel, the left and right portions of each of said opposite longitudinally-extending sides of the channel being tapered laterally outwardly of the channel from the center of the longitudinally-extending side; and (iii) a holder for securing one or more of the covering elements to the carrier.

2. The carrier and spacer assembly of claim 1 wherein the left and right portions of each longitudinally-extending side of the channel is tapered laterally outwardly of the channel from the center of each longitudinally-extending side at an angle of less than 10°.

3. The carrier and spacer assembly of claim 2 wherein the left and right portions of each longitudinally-extending side of the channel is tapered laterally outwardly of the channel from the center of each longitudinally-extending side at an angle of about 0.5–5°.

4. A carrier and spacer assembly for an architectural covering, wherein the architectural covering comprises a plurality of covering elements, the assembly comprising:

a longitudinally-extending tilt rod;

a plurality of longitudinally extending spacers, each spacer having a first end and a second end; and a plurality of carriers slidably arranged along the tilt rod for movement between a first position and a second position, the plurality of carriers being spaced apart from each other with a spacer extending between adjacent carriers in a first position and the plurality of carriers being located adjacent to one another substantially at one end of the tilt rod in the second position, each carrier having a connector for connecting the carrier with at least one covering element;

wherein, as the plurality of carriers are moved toward the first position, the first end of a first spacer engages a first carrier at a first location to transfer a movement force from the first carrier to the first spacer, and the second end of the first spacer engages a second carrier at a second location to transfer the movement force from the first spacer to the second carrier, a first distance between the first location and the tilt rod being greater than a second distance between the second location and the tilt rod.

5. The carrier and spacer assembly of claim 4, wherein the plurality of spacers are elongated and are substantially parallel with the tilt rod.

6. The carrier and spacer assembly of claim 5, wherein the plurality of spacers are laterally spaced from the tilt rod.

7. A covering assembly for an architectural opening, the covering assembly comprising:

a longitudinally-extending head rail;

a plurality of longitudinally-extending spacers;

a plurality of louvers; and a plurality of carriers slidably attached to the head rail, each carrier including (i) a louver holder with at least one louver of the plurality of louvers attached thereto, and (ii) a longitudinally-extending channel in which at least one longitudinally-extending spacer is slidably positioned, said channel including opposite generally longitudinally-extending sides, each longitudinally-extending side having a center with left and right portions on either side of the center that terminate at opposite laterally-extending sides of the channel, the left and right portions of each of said opposite longitudinally-extending sides of the channel being tapered laterally outwardly of the channel from the center of the longitudinally-extending side.

8. The covering of claim 7, wherein (i) the opposite longitudinally-extending sides are upstanding, (ii) the channel comprises a longitudinally-extending horizontal surface, and (iii) a trailing end portion of a first longitudinally extending spacer underlies a leading end portion of an adjacent second longitudinally extending spacer on the horizontal surface.

9. The covering of claim 7, wherein the left and right portions of each longitudinally-extending side of the channel is tapered laterally outwardly of the channel from the center of each longitudinally-extending side at an angle of less than 10°.

10. The covering of claim 9, wherein the left and right portions of each longitudinally-extending side of the channel is tapered laterally outwardly of the channel from the center of each longitudinally-extending side at an angle of 0.5–5°.

11. A carrier and spacer assembly for a head rail of a covering for an architectural opening, the covering including a plurality of louvers, the carrier and spacer assembly comprising (i) at least one elongated spacer and (ii) a longitudinally-extending channel with the at least one spacer received therein, the channel including (i) a first upstanding side with left and right portions, the left and right portions of the first upstanding side intersecting proximate a center of the first upstanding side, (ii) a second upstanding side spaced from and facing the first upstanding side, the second upstanding side having left and right portions, the left and right portions of the second upstanding side intersecting proximate a center of the second upstanding side, and (iii) a bottom surface spanning between and intersecting a bottom edge of each of the first and second upstanding side, each left and right portion of the first and second upstanding sides tapering laterally outwardly of the channel from an intersection with the other of the left and right portion of the respective first or second upstanding side.

12. The carrier and spacer assembly of claim 11, wherein the bottom surface extends substantially the entire lengths of the first and second upstanding sides.

13. The carrier and spacer assembly of claim 11, wherein the bottom surface includes a generally vertically extending hole therein.

14. The carrier and spacer assembly of claim 11, wherein each right and left portion of the first and second longitudinally-extending sides of the channel is tapered laterally outwardly of the channel from the intersection at an angle of less than about 10°.

15. The carrier and spacer assembly of claim 14, each right and left portion of the first and second longitudinally-extending sides of the channel is tapered laterally outwardly of the channel from the intersection at an angle of about 0.5–5°.

16. The carrier and spacer assembly of claim 11, further comprising first and second laterally-extending sides located at opposite ends of the channel, each laterally-extending side spanning a distance between the respective left or right portions, each of the first and second laterally-extending sides further extending generally vertically downwardly from the bottom surface.

17. The carrier and spacer assembly of claim 16 wherein (i) the at least one elongated spacer includes at least two longitudinally extending spacers (ii) the opposite longitudinally-extending sides are upstanding, and (iii) the channel comprises a longitudinally-extending horizontal surface; a trailing end portion of a first longitudinally extending spacer underlies a leading end portion of an adjacent second longitudinally extending spacer on the horizontal surface.

18. The carrier and spacer assembly of claim 11, further comprising a holder adapted to secure one or more louvers of the covering to the carrier.

* * * * *